United States Patent [19]

Llewellyn

[11] Patent Number: 4,954,810

[45] Date of Patent: Sep. 4, 1990

[54] GARAGE DOOR OPENERS

[76] Inventor: Theodore E. Llewellyn, 212 River Oaks, Bakersfield, Calif. 93309

[21] Appl. No.: 468,057

[22] Filed: Jan. 22, 1990

[51] Int. Cl.[5] ..... G08B 13/08; G08B 25/02

[52] U.S. Cl. ..... 340/545; 340/539; 340/691; 340/692

[58] Field of Search ..... 340/545, 539, 691, 692, 340/502, 686, 825, 65, 313; 341/176; 200/61.62, 61.71, 61.73; 368/10; 318/266, 466, 285; 455/70, 88

[56] References Cited

U.S. PATENT DOCUMENTS

| | | | |
|---|---|---|---|
| 4,048,630 | 9/1977 | Deming et al. | 200/61.62 X |
| 4,121,160 | 10/1978 | Cataldo | 340/539 X |
| 4,234,833 | 11/1980 | Barrett | 318/282 |
| 4,463,292 | 7/1984 | Engelmann | 318/283 |
| 4,496,942 | 1/1985 | Matsuoka | 341/176 X |
| 4,583,081 | 4/1986 | Schmitz | 340/545 |

*Primary Examiner*—Joseph A. Orsino
*Assistant Examiner*—Thomas J. Mullen, Jr.
*Attorney, Agent, or Firm*—I. Michael Bak-Boychuk

[57] ABSTRACT

A signaling system is provided for an automated garage door including a transmitter rendered operative upon the opening of the door and a receiver stage which may be adhesively mounted on the remote sending unit by which door operation is signalled. The receiver stage includes a clock and an audio signal generator both of which are disabled by a reset switch. A bar is adhesively affixed to this reset switch and to the sending unit for common manual articulation of a door closing signal and a reset signal.

6 Claims, 2 Drawing Sheets

GARAGE DOOR OPENERS

BACKGROUND OF THE INVENTION

1. FIELD OF THE INVENTION

The present invention relates to automated garage door openers, and more particularly to signaling devices therefor.

1. DESCRIPTION OF THE PRIOR ART

Automated garage door openers have been known in the past. Typically, such prior art garage door openers include a source of motive power, gearing connecting same to the door, and a control assembly for selecting the direction and the distance of movement of the door. Preferably, such garage door openers entail electrical excitation to the source of motive power, with the control assembly including limit switches and the like. The user then, either through the manual operation of a wall switch or through a remote sending unit, sets off the opening or closing sequence.

This general arrangement, while suitable for the purposes intended, requires attention from the user in selecting the closing or opening mode. Thus, once the user drives the vehicle out of the garage his further attention is required to close the garage door thereafter. Of course, such attention is sometimes lacking in the course of human events and, on frequent occasion, the user is left wondering whether he has closed the door. With equal frequency these instances of wonderment and efforts at recall are at a distance greater than the effective signaling instance of the sending unit. The user is, therefore, left with a persistent doubt until he returns to the garage.

For all the foregoing reasons a convenient arrangement has been sought for informing the user of the state of the door. It is one such arrangement that is set out below.

SUMMARY OF THE INVENTION

Accordingly, it is the general purpose and object of the present invention to add to a conventional garage door opening system a signaling arrangement for providing a signal indicative of the opening state of the door.

Other objects of the invention are to include in a remote signaling unit for garage doors an indication of the state of the door.

Yet further objects of the invention are to provide a reminder arrangement in a remote signaling unit for providing a perceptible signal indicative of the state of the door.

Briefly, these and other objects are accomplished within the present invention by providing a radio frequency (RF) signal source in a garage door operating system enabled for RF transmission by the state of the door. More precisely, an RF transmitter is added to an automated garage door operating system, in circuit with a limit switch set to open upon the complete closure of the door. The RF signal emitted by the source may be pulse modulated and inscribed for a particular code pattern. Two sets of receivers are then provided, one installed in the household serviced by the garage and the other in the remote sending unit typically provided for remote operation of the garage door, or in the vehicle.

Preferably, the second receiver, installed in the remote sending unit or in the vehicle, is provided with a voice synthesizer to emit an audio message like, "Garage Door". When the hand held remote sending unit is depressed to close the door the clock is stopped to later reveal what time, date and morning or afternoon the door was last closed. The first receiver in the household, in turn, provides a light signal in response to the receipt of the coded RF signal.

In this manner, the operator of the vehicle equipped with the remote sending unit is advised of the state of the door. This advice, in the form of a voice synthesized message, continues as long as the vehicle remains in the sending range of the RF transmitter. Once out of this range the operator can refer to the clock to determine if, in fact, he has closed the door.

Preferrably, the RF source is of low wattage to minimize all possible cross-talk or interference. In consequence only a limited range is effected, a range sufficient to remind the operator. One timing output of the clock is then useful to disable the audio signal to limit power consumption when parked at the garage site with the garage door open.

DESCRIPTION OF THE PREFERRED EMBODIMENT

Figure 1:
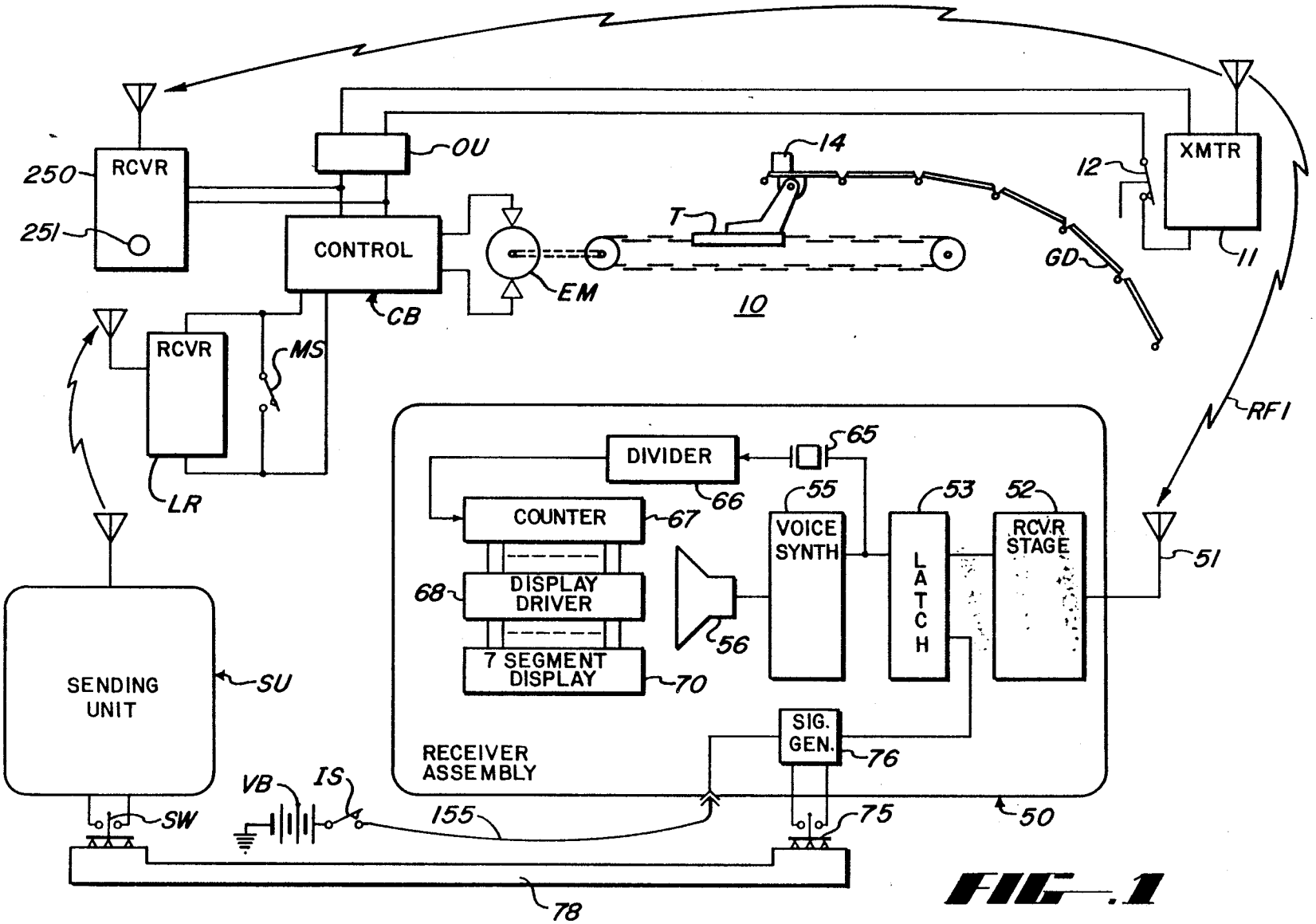
FIG. 1 is a block diagram of a conventional automated garage door operating system, including the inventive signaling arrangement.
Figure 2:
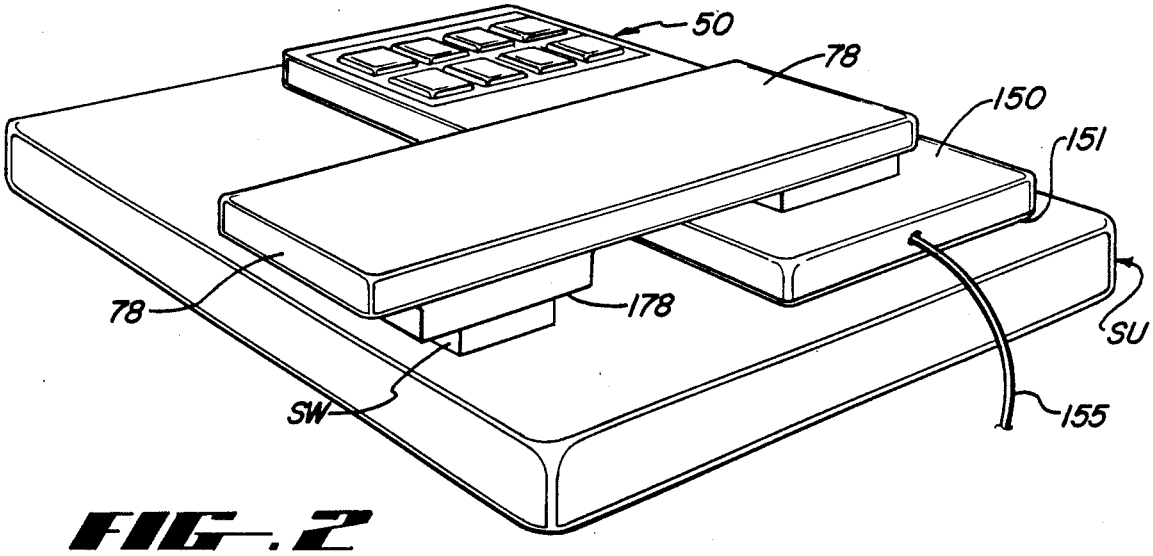
FIG. 2 is a perspective illustration of the inventive signaling device conformed for mounting onto a conventional remote signaling unit.
Figure 3:
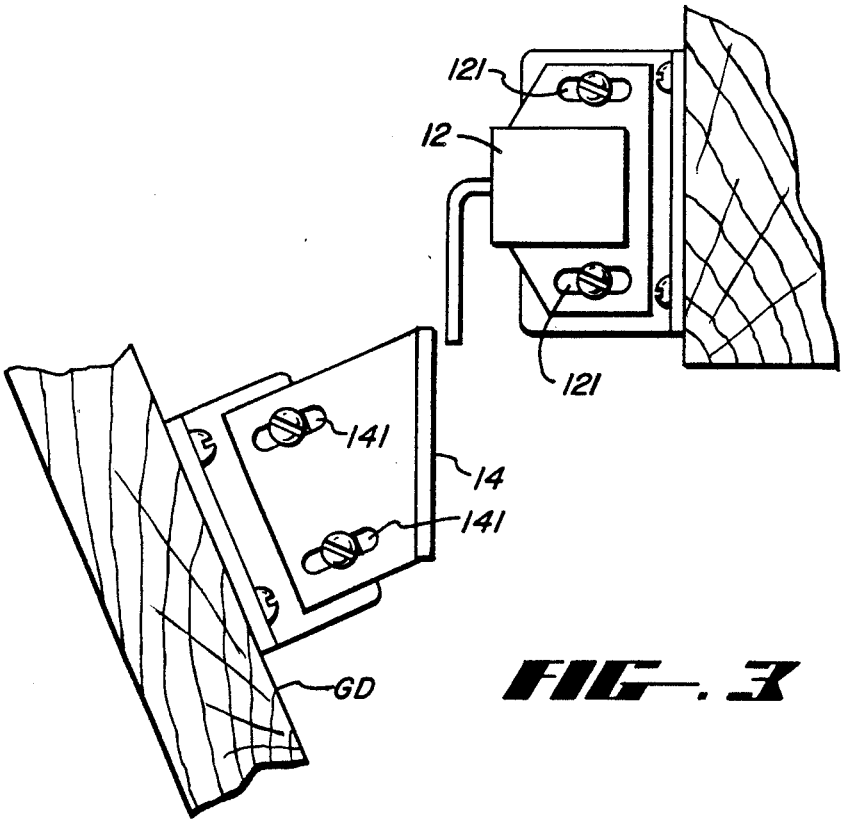
FIG. 3 is yet another perspective illustration of a door switch useful with the present invention.

As shown in FIGS. 1–3 a typical garage door mechanism includes an electrical motor EM tied across a control box CB to any conventional electrical outlet OU, the motor EM then driving a trolley T (or other mechanical device like a screw jack) which is linked to the garage door GD. Most frequently the control box CB includes a variety of switching devices such as one, (or more) manual switch MS and a local receiver LR responsive to the output of a portable remote sending unit SU carried along in the vehicle.

This arrangement has had extensive commercial acceptance and is found, in one form or another, in various residences. In view of the potential interference with other radio reception the power output, bandwidth and various switching spikes of the sending unit SU are all closely regulated by various statutory enactments and for that reason only a limited range of operation is available. Moreover, as the number of such automated systems grows even lower power levels are anticipated.

Thus, the user of such a remote signaling device SU must pay close attention to the range of the second (door closing) signal and cannot correct an oversight once having departed.

These oversights occur with a fair amount of regularity. To correct such oversights the inventive system 10 provides a transmitter 11 connected to the power outlet OU across a push-to-open limit switch 12. This limit switch is arranged for actuation by a tripping projection 14 selectively mounted of the door GD. Thus, as long as the door GD is open power is supplied to the transmitter 11. This results in a radiated radio pattern (signal RFI) which, for the same reasons as those earlier stated, is limited in bandwidth and power. In consequence the range of signal RFI is limited as is the range of the sending unit SU.

To detect the signal RFI a receiver assembly 50 is provided with an antenna 51 tied to a receiver stage 52. The output of the receiver stage 52 then latches a latch 53 which, on its latched output, sets off both a voice synthesizer 55 and an oscillator 65. The voice synthesizer then projects through a speaker 56 an audio message such as "Garage Door". The oscillator 65, across a variety of divisions in a divide circuit 66, then drives a clock counter 67 with the output thereof connected across a display driver 68 to a seven segment display 70. A push-to-close switch 75 then drives a pulse generator 76 to unlatch the latch 53 and to concurrently clear the time count in counter 67. This push-to-close switch 75 extends to the exterior of the assembly 50 to align subjacent an extension bar 78 adjacently fixed to the manual switch SW on the face of the signaling unit SU.

To effect this mounting assembly 50 is housed in a thin, generally rectangular housing 150 provided with an adhesive layer 151 on the back side thereof. In this arrangement the housing 150 may be variously arranged on the face of the sending unit SU in adjacent proximity with the switch SW. The bar 78 is similarly backed with an adhesive layer 178 and when adhered to switch SW extends over switch 75 for common actuation.

In this manner the assembly 50 may be conveniently added to the sending unit SU. Unlike the momentary power draw of the unit SU the monitoring levels of assembly 50 persist and, for that reason, power may be provided by way of a pigtail connection 155 extending to any accessory terminal of the vehicle, in circuit with the ignition switch IS. Thus, the vehicle battery VB is useful in providing power to the assembly 50 and once the vehicle is turned off all further signal processing is concurrently cleared. (Alternatively, assembly 50 may include its own power source selectively switched by the operator).

One should note that the location of projection 14 and switch 12 can be similarly selected with ease by way of fasteners 121 and 141 extending through slots 122 and 142. Concurrently a receiver 250 may be tied to the house power OU to turn on a light 251 each time the transmitter 11 is excited.

One should note that receiver stage 52, transmitter 11 and receiver 250 all include the requisite pulse code logic (not shown) implemented similar to the various pulse coding techniques now found in the conventional remote sending unit SU.

In this manner an aftermarket assembly is devised which conveniently expands the functions of a prior art garage door operating system.

Obviously many modifications and changes may be made to the foregoing description without departing from the spirit of the invention. It is therefore intended that the scope of the invention be determined solely on the claims appended hereto.

What is claimed is:

1. In an automated door operating system characterized by a source of motive power connected to operate said door, a control system for controlling said source of motive power and a remote sending unit conformed to issue signals to said control system for directing the operation of said door, the improvement comprising:

a radio frequency transmitter deployed adjacent said door and rendered operative to produce a first radio signal upon the opening of said door; and a first radio frequency receiver attached to said sending unit and including a clock rendered operative in response to the receipt of said first radio signal, an audio signal source concurrently actuated with said clock, and signaling means concurrently actuated with said sending unit for terminating the operation of said clock upon the actuation thereof.

2. Apparatus according to claim 1 wherein:

said radio frequency transmitter includes a limit switch aligned for actuation by said door.

3. Apparatus according to claim 2 wherein:

said limit switch is a normally closed switch.

4. Apparatus according to claim 2 further comprising:

a second radio frequency receiver deployed in proximity of said door and conformed to respond to said first radio signal, said second receiver including a light rendered operative by said first radio signal.

5. Apparatus according to claim 1 wherein:

said first radio frequency receiver is adhesively secured to said sending unit.

6. In a garage door operating system provided with a source of motive power connected to said door, a control system for directing the movement of said source of motive power in response to a first radio signal emitted by a portable sending unit, the improvement comprising:

a radio frequency transmitter rendered operative upon the opening of said door for producing a second radio signal indicative thereof;

a first radio frequency receiver secured to said sending unit and including a clock rendered operative by said second radio signal and a resetting circuit for resetting said clock rendered operative by a manual articulation of a reset switch; and means connected to said reset switch and deployed adjacent said sending unit for concurrent articulation of said reset switch and said sending unit.

* * * * *